US006035818A

United States Patent [19]

Sato et al.

[11] Patent Number: 6,035,818

[45] Date of Patent: Mar. 14, 2000

[54] VARIABLE VALVE CONTROL APPARATUS

[75] Inventors: Osamu Sato, Takahama; Jouji Yamaguchi, Kariya; Yoshihito Moriya, Nagoya; Noriyuki Iden, Toyota; Shinitiro Kikuoka, Nishikamo-gun; Kiyoshi Sugimoto, Okazaki, all of Japan

[73] Assignees: Denso Corporation, Kariya; Toyota Jidosha Kabushiki Kaisha, Toyota, both of Japan

[21] Appl. No.: 09/238,178

[22] Filed: Jan. 28, 1999

[30] Foreign Application Priority Data

Jan. 29, 1998 [JP] Japan ..... 10-017233

[51] Int. Cl.[7] ..... F01L 13/00; F01L 1/34

[52] U.S. Cl. ..... 123/90.17; 123/90.18; 123/90.31

[58] Field of Search ..... 123/90.15, 90.17, 123/90.18, 90.31

[56] References Cited

U.S. PATENT DOCUMENTS

| | | | |
|---|---|---|---|
| 4,517,936 | 5/1985 | Burgio di Aragona . | |
| 4,693,214 | 9/1987 | Titolo . | |
| 4,858,572 | 8/1989 | Shirai et al. . | |
| 5,080,055 | 1/1992 | Komatsu et al. | 123/90.17 |
| 5,381,764 | 1/1995 | Fukuma et al. | 123/90.17 |
| 5,765,518 | 6/1998 | Nakano | 123/90.17 |
| 5,893,345 | 4/1999 | Sugimoto et al. | 123/90.17 |
| 5,924,397 | 7/1999 | Moriya et al. | 123/90.18 |

FOREIGN PATENT DOCUMENTS

| | | |
|---|---|---|
| B2-2620129 | 5/1990 | Japan . |
| 5-106411 | 4/1993 | Japan . |
| 7-301106 | 11/1995 | Japan . |
| 9-32519 | 2/1997 | Japan . |
| 9-151710 | 10/1997 | Japan . |

OTHER PUBLICATIONS

SAE 910009, Titolo, "The Variable Valve Timing System," 1991.

*Primary Examiner*—Weilun Lo
*Attorney, Agent, or Firm*—Nixon & Vandherhye P.C.

[57] ABSTRACT

A variable valve control apparatus which is capable of reducing the size of the entire apparatus. A rotary member is assembled with a timing pulley by a bolt so that it rotates together with the timing pulley. A cylinder head supports the rotary member rotatably but axially immovably. The rotary member supports an intake camshaft rotatably and axially movably. Even if the intake camshaft is axially moved and changed in rotational phase relative to the timing pulley as arc-shaped gears move axially, the rotational phase between an exhaust camshaft and the timing pulley does not change.

6 Claims, 4 Drawing Sheets

VARIABLE VALVE CONTROL APPARATUS

CROSS REFERENCE TO RELATED APPLICATION

This application is based upon and claims priority from Japanese Patent Application No. Hei 10-17233 filed Jan. 29, 1998, the contents of which are incorporated herein by reference.

BACKGROUND OF THE INVENTION

1. Field of the Invention

The present invention relates to a variable valve control apparatus capable of changing the timing of opening/closing and the lifting stroke of at least one of the intake valve and the exhaust valve of an internal combustion engine (as will be shortly referred to as the "engine") in accordance with the running conditions.

2. Description of Related Art

As disclosed in JP-A-9-32519, there is a known variable valve control apparatus in which the valve-open period and the lifting stroke of at least one of an intake valve and an exhaust valve are changed by axially shifting a camshaft including a cam having an axially different profile.

Another variable valve control apparatus in which the rotational phase of a camshaft with respect to a crankshaft is adjusted to adjust the value opening/closing timing variably is disclosed in JP-A-1-92504.

Another variable valve control apparatus in which camshafts for driving the intake valve and the exhaust valve respectively are coupled by gears and in which the camshaft for receiving the torque of the crankshaft drives the other camshaft is disclosed in JP-A-5-106411.

When axial moving means for changing the valve-open period and the lifting stroke of at least one of the aforementioned intake valve and exhaust valve and phase adjusting means for adjusting the rotational phase of the camshaft with respect to the crankshaft are combined, a separate arrangement of the two means increases the number of parts and accordingly the number of their assembling steps.

It may be possible to combine the camshafts through gears such that one camshaft drives the other camshaft. When one of the camshafts axially moves, however, a gear with the moved camshaft also moves together with the camshaft, so that the gear engagement may disappear or their coupling length may be shortened to fail to transmit the torque sufficiently. This torque transmission could be retained by enlarging the axial length of the gears, but such enlargement of the gears may cause a problem that the gears and the entire apparatus will be increased in size.

Since the torque necessary for driving the cam-shafts is high, helical gears are generally used for transmitting the torque between the camshafts. With this helical gear coupling, when one camshaft axially moves, the other camshaft rotates relative to the one camshaft, so that the relative phase between these camshafts may be changed.

If the gear coupling is applied to spur gears, one camshaft does not change in phase even when the other camshaft moves in the axial direction. If the phase of one camshaft changes relative to the crankshaft, however, the other camshaft also changes in phase, so that the relative phase between these camshafts cannot be adjusted.

SUMMARY OF THE INVENTION

The present invention is made in light of the foregoing problems, and it is an object of the present invention to provide a variable valve control apparatus which is capable of decreasing the number of parts by constructing phase adjusting means and axial moving means together, thereby reducing the number of their assembling steps and the size of the entire apparatus and lowering the production cost.

Another objective of the present invention is to provide a variable valve control apparatus which is capable of adjusting the relative phase between the driven shafts accurately by transmitting the torque from the drive side rotor to a first driven shaft such that a rotational phase therebetween is adjustable, and to a second driven shaft such that a rotational phase therebetween is not adjustable.

According to a variable valve control apparatus of the present invention, there is provided a variable valve control apparatus in which phase adjusting means for adjusting the opening/closing timing of a valve by controlling the rotational phase of a driven side rotor hydraulically with respect to a drive side rotor and axial moving means for adjusting the open period and lifting stroke of the valve by hydraulically controlling the axial movement of a piston member moving axially together with a first driven shaft are constructed of one drive means. As a result, the number of parts and accordingly the number of their assembling steps can be decreased to reduce the size of the apparatus and to lower the production cost.

According to another aspect of the invention, a rotary member for supporting the first driven shaft relatively rotatably and for rotating together with the drive side rotor drives a second driven shaft so that the torque of the drive shaft can be transmitted from one drive side rotor to the two driven shafts for driving an intake valve and an exhaust valve individually. As a result, the number of parts for transmitting the torque to the two driven shafts and the number of their assembling steps can be decreased to reduce the size of the apparatus and to lower the production cost.

Since the rotary member for rotating together with the drive side rotor and for supporting the first driven shaft relatively rotatably drives the second driven shaft, moreover, the rotational phase of the second driven shaft with respect to the drive side rotor does not change even if the rotational phase of the first driven shaft changes with respect to the drive side rotor. As a result, the relative phases of the driven shafts can be controlled highly accurately.

Since the rotary member supported axially immovably drives the second driven shaft made axially immovable, moreover, the portion of the rotary member for transmitting the torque and the portion of the second driven shaft for receiving the torque do not go out of position. As a result, the torque can be easily transmitted from the rotary member to the second driven shaft not only by the gears but also by a belt or chain. When the gears are used, still moreover, their coupling does not go out of position so that the axial gear length for retaining the coupling length need not be enlarged. Even when the first driven shaft axially moves, furthermore, the rotary member does not axially move so that the rotational phase of the second driven shaft relative to the rotary member or the drive side rotor does not change even if the gears are embodied by helical gears for enhancing their coupling force.

According to another aspect of the invention, low pressure passages are arranged on the two axial sides of a high pressure passage at the rotational sliding portions between the rotary member and the support member for supporting the former rotatably. When a working fluid under a high pressure leaks from the high pressure passage into the low pressure passages, therefore, it can leak out from the low pressure passages to the axial end portion of the rotary sliding portions. As a result, the pressure rise in the low pressure passages can be prevented to facilitate the control of the pressure difference between the high pressure passage and the low pressure passages thereby to control the phase of the first driven shaft relative to the drive shaft with high degree of accuracy.

As compared with the case in which the high pressure passage is arranged on the axial end portion of the low pressure passage, the pressure difference between the axial end portion and the low pressure passage can be made lower to reduce the leakage of the working fluid. As a result, the control response is improved.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

Preferred embodiments of the present invention will now be described with reference to the accompanying drawings.

[First Embodiment]

Figure 1:
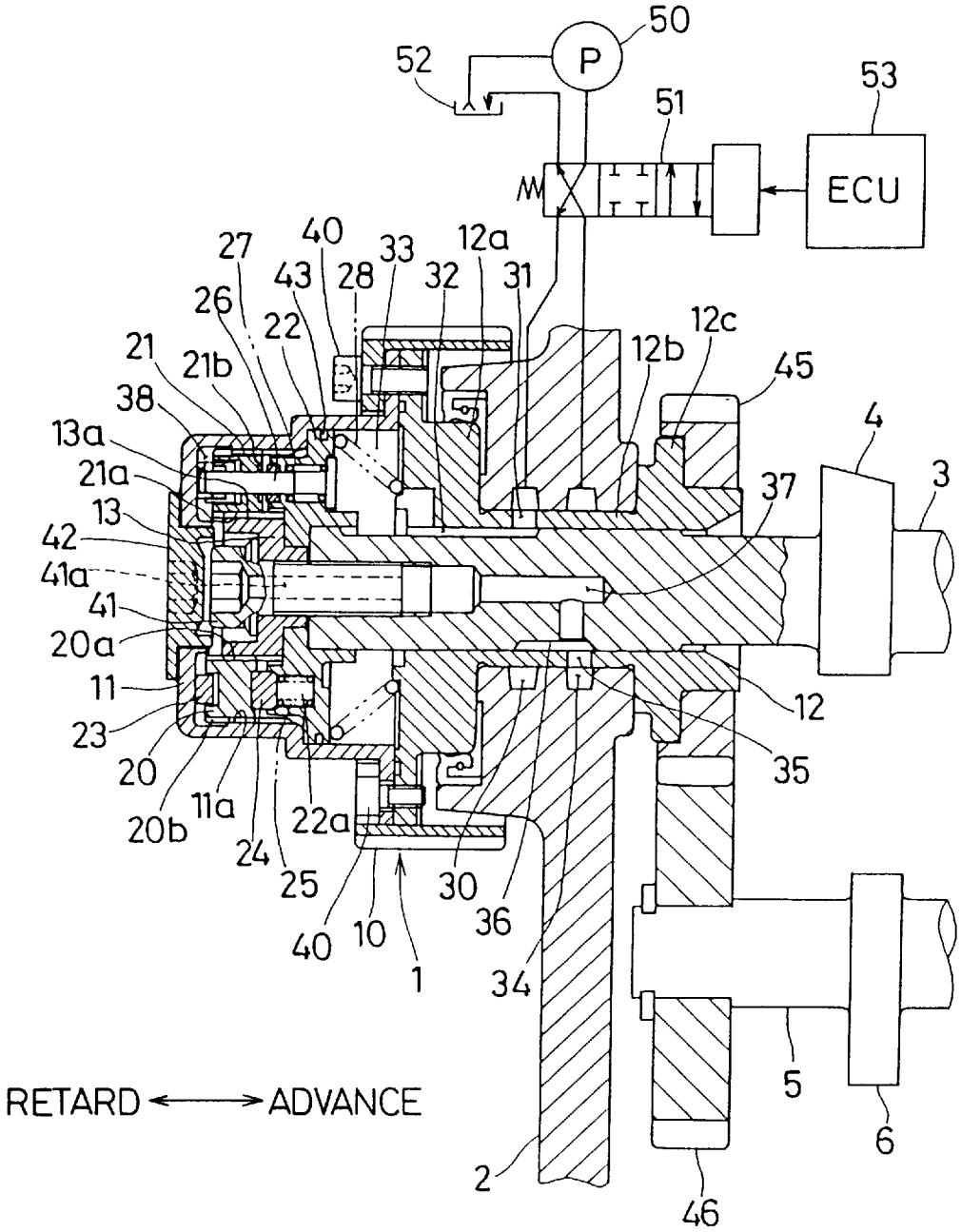
FIG. 1 is a longitudinal sectional view showing a variable valve control apparatus according to a first embodiment of the present invention.

A variable valve control apparatus according to a first embodiment of the present invention is shown in FIG. 1. A variable valve control apparatus 1 of the first embodiment is a hydraulic control type for transmitting the torque of a crankshaft (not shown) as a drive shaft to an intake camshaft 3 and an exhaust camshaft 5. The intake camshaft 3 corresponding to a first driven shaft is movable in its axial direction. A multi-dimensional cam 4 for opening and closing the intake valve is mounted on the intake camshaft 3. The multi-dimensional cam 4 has a different profile in the axial direction, and its left-hand side of FIG. 1 is for high speed rotations whereas its right-hand side of FIG. 1 is for low speed rotations. The exhaust camshaft 5 corresponding to a second driven shaft cannot move in its axial direction. A cam 6 for opening and closing the exhaust valve is mounted on the exhaust camshaft 5. The cam 6 has a uniform profile in the axial direction.

A housing 11 and a rotary member 12 are attached to a timing pulley 10 by a bolt 40 to construct a drive side rotor together with the timing pulley 10. A helical spline 11*a* having internal teeth is formed in a part of the inner circumferential wall of the housing 11. The timing pulley 10 and the intake camshaft 3 rotate clockwise as viewed from the left-hand side of FIG. 1.

An annular portion 12*a*, a cylindrical portion 12*b* and an annular portion 12*c* are integrally formed to form the rotary member 12. The rotary member 12 is rotatably supported by a cylinder head 2 which corresponds to a support member. The rotary member 12 rotatably supports the intake camshaft 3. The intake camshaft 3 can, rotate and is movable in its axial direction against the rotary member 12. Only small clearances for allowing rotational movements are formed axially between the cylinder head 2 and the annular portions 12*a* and 12*c* so that the rotary member 12 cannot axially move.

By a not-shown bolt, a gear 45 is attached to the rotary member 12. A gear 46 is attached to the exhaust camshaft 5. By engaging the gear 45 and the gear 46, the torque of the crankshaft is transmitted to the exhaust camshaft 5 with the same phase of the crankshaft through the timing pulley 10, the rotary member 12, the gear 45 and the gear 46.

A spline member 13 and a piston member 22 corresponding to axial moving means are fixed on one end portion of the intake camshaft 3 by a bolt 41 and a not-shown pin so that they rotate together with the intake camshaft 3 and axially move together with the intake camshaft 3. An external helical spline 13*a* is formed on the portion of the outer circumferential wall of the spline member 13 corresponding to a driven side rotor.

Between the housing 11 and the spline member 13 in the radial direction, there are interposed two arc-shaped gears 20 and two arc-shaped gears 21 for rotating the timing pulley 10 and the intake camshaft 3 relative to each other. In other words, the arc-shaped gears 20 and 21 change the rotational phase difference between the intake camshaft 3 and the timing pulley 10, as phase adjusting means. These arc-shaped gears 20 and 21 are formed by dividing one ring-shaped gear in a division plane containing the axis. The intake camshaft 3 relatively rotates toward the advanced angle side with respect to the timing pulley 10 when the arc-shaped gears 20 and 21 move toward the advance side as indicated by an arrow in FIG. 1. The intake camshaft 3 relatively rotates toward the retarded angle side with respect to the timing pulley 10 when the arc-shaped gears 20 and 21 rotate toward the retard side as indicated by an arrow in FIG. 1. The arc-shaped gears 20 and 21 are assembled so alternately in the circumferential direction on the piston member 22 that they apparently comprise one ring-shaped gear. In the upper end portions of the arc-shaped gears 20 and 21, there are formed arc-shaped grooves in which a retainer ring 23 is housed.

Accommodation hole 22*a* is formed at a position corresponding to the arc-shaped gears 20 in the piston member 22. In the accommodation holes 22*a*, a spring 25 is accommodated for applying a spring force to an annular member 24 and the arc-shaped gears 20 leftward in FIG. 1, that is, in the direction away from the piston member 22.

A pin 26 is so inserted into the piston member 22 and the arc-shaped gears 21 as to move back and forth, and is slidably fitted in the annular member 24. Moreover, the pin 26 is press-fitted in the retainer ring 23 so that the retainer ring 23 and the pin 26 move together. The pin 26 is biased rightward in FIG. 1 by the spring force of a spring 27, so that the retainer ring 23 and the arc-shaped gears 21 are also biased rightward in FIG. 1, that is, in the direction to approach the piston member 22, as opposed to the bias direction of the arc-shaped gears 20 by the spring 25.

Internal helical splines 20*a* and 21*a* are formed on the inner circumferential wall of the arc-shaped gears 20 and 21 respectively, and external helical splines 20*b* and 21*b* are formed on the outer circumferential wall of the arc-shaped gears 20 and 21 respectively. The arc-shaped gears 20 and 21 are biased in an axially opposite direction each other, so that the axial positions of the external helical splines 20*b* and 21*b* and the internal helical splines 20*a* and 21*a* are further deviated from those in FIG. 1 before the arc-shaped gears 20 and 21 are interposed between the housing 11 and the spline member 13.

The arc-shaped gears 20 and 21 move, when interposed between the housing 11 and the spline member 13, by a small distance in the axial and rotational directions of the intake camshaft 3 to an extent to absorb the backlash between the splines so that they are interposed with a smaller axial displacement than before between the housing 11 and the spline member 13. The springs 25 and the spring 27 respectively applies the spring force to the arc-shaped gears 20 and 21 respectively in the axially opposite directions with respect to the piston member 22. These spring forces generate torque such that the arc-shaped gear 20 tries to rotate the intake camshaft 3 in the retarded angle direction relative to the timing pulley 10, and generate torque such that the arc-shaped gear 21 tries to rotate the intake camshaft 3 in the advanced angle direction relative to the timing pulley 10. In other words, by the spring force of the spring 25, the external helical spline 20*b* of the arc-shaped gears 20 pushes the internal helical spline 11*a* of the housing 11 in the retard direction, and the internal helical spline 20*a* pushes the external helical spline 13*a* of the spline member 13 in the retard direction. By the spring force of the spring 27, on the other hand, the external helical spline 21*b* of the arc-shaped gears 21 pushes the internal helical spline 11*a* of the housing 11 in the advance direction, and the internal helical spline 21*a* pushes the external helical spline 13*a* of the spline member 13 in the advance direction. As a result, the arc-shaped gears 20 and 21 are given by the spring forces of the springs 25 and 27 the torque against the positive/negative fluctuating torque to be received by the intake camshaft 3 when the intake valve is opened/closed, so that the chattering noise due to the backlash between the splines is reduced.

By these engagements between the splines, the torque of the timing pulley 10 is transmitted to the intake camshaft 3 through the housing 11, the arc-shaped gears 20 and 21 and the spline member 13.

A spring 28 is installed between the annular portion 12*a* and the piston member 22 to bias the piston member 22 leftward in FIG. 1, that is, toward the retard side. By the bias force (spring force) of this spring 28, the arc-shaped gears 20 and 21 and the piston member 22 are biased leftward in FIG. 1, so that the intake camshaft 3 is biased toward the retard side through the spline member 13 against the timing pulley 10.

A retard oil pressure chamber 33 is formed on the right of the piston member 22, and an advance oil pressure chamber 38 is formed on the left of the piston member 22. These retard and advance oil pressure chambers 33 and 38 are sealed by a bolt 42 and the housing 11, and substantially sealed by the cylindrical portion 12*b* of the rotary member 12. The retard and advance oil pressure chambers 33 and 38 are sealed with a seal member 43 made of resin, fitted on the outer circumference of the piston member 22.

At the rotational sliding portions with the rotary member 12, there are formed in the inner circumferential wall of the cylinder head 2 annular oil passages 30 and 34. These oil passages 30 and 34 can be connected through a switching valve 51 to a hydraulic pump 50 as a drive source or a drain 52. The switching valve 51 changes the connections between the oil passages 30 and 34 and the hydraulic pump 50 or the drain 52 in response to a command from an engine control unit (ECU) 53.

The oil passage 30 communicates with the retard oil pressure chamber 33 through a communication port 31 formed in the cylindrical portion 12*b* and through an oil pressure chamber 32 having an arc-shaped cross section formed in the outer circumferential wall of the intake camshaft 3. The oil pressure chamber 32 is always kept to have communication with the communication port 31 no matter whether the intake camshaft 3 might rotate within a predetermined range with respect to the rotary member 12 or might axially move with respect to the rotary member 12.

The oil passage 34 communicates with the advance oil pressure chamber 38 through a communication port 35 formed in the cylindrical portion 12*b*, an oil pressure chamber 36 having an arc-shaped cross section formed in the outer circumferential wall of the intake camshaft 3, an oil passage 37 formed at the center portion of the intake camshaft 3, and an oil passage 41*a* formed in the bolt 41. The oil pressure chamber 36 is always kept to communicate with the communication port 35 no matter whether the intake camshaft 3 might rotate within a predetermined range relative to the rotary member 12 or might axially move against the rotary member 12.

By switching the switching valve 51 to change the connections between the oil passages 30, 34 and the hydraulic pump 50 or the drain 52, the oil pressures of the retard oil pressure chamber 33 and the advance oil pressure chamber 38 are adjusted. By changing the axial positions of the arc-shaped gears 20 and 21 and the piston member 22, (1) the rotational phase of the intake camshaft 3 relative to the timing pulley 10 is controlled to adjust the timing of opening/closing the intake valve. Moreover, (2) the intake camshaft 3 is axially moved or stopped together with the piston member 22, so that the profile of the cam 4 for driving the intake valve is changed to control the opening/closing timing, the open period and the lifting stroke of the intake valve.

According to the first embodiment of the present invention, the rotary member 12, for rotatably supporting the intake camshaft 3 and for allowing axial movement of the intake camshaft 3, is supported axially immovably by the cylinder head 2. Accordingly, even if the oil pressure to be applied to the retard oil pressure chamber 33 and the advance oil pressure chamber 38 is controlled to move the intake camshaft 3 axially together with the piston member 22, the rotary member 12 does not axially move. Therefore, it is unnecessary to elongate the gears 45, 46 for compensating the axial movement of the gear 45.

Furthermore, even if the rotational phase of the intake camshaft 3 relative to the timing pulley 10 changes according to the axial movement of the arc-shaped gears 20, 21, the rotational phase of the exhaust camshaft 5 relative to the timing pulley 10 does not change. Moreover, since the gear 45 does not move axially even if the intake camshaft 3 moves axially, the rotational phase of the exhaust camshaft 5 relative to the timing pulley 10 does not change according to the axial movement of the intake camshaft 3 even if the gears 45, 46 are coupled by helical gears. As a result, the phase of the exhaust valve relative to the crankshaft is always maintained constant. Accordingly, the phase of the intake valve relative to the exhaust valve is controlled with high accuracy. Moreover, the coupling force between the gear 45 and the gear 46 is increased by making them helical.

In the first embodiment, on the other hand, the arc-shaped gears 20 and 21 are urged in the axially opposite directions and away from each other through the piston member 22 by the urging forces of the springs 25 and 27. On the side of the housing 11, therefore, the external helical splines 20*b* and 21*b* of the arc-shaped gears 20 and 21 respectively contact against the internal helical splines 11*a* of the housing 11 while applying the torque thereto in the opposite directions. On the side of the spline member 13, the internal helical splines 20*a* and 21*a* of the arc-shaped gears 20 and 21 respectively contact against the external helical spline 13*a* of the spline member 13 while applying the torque thereto in the opposite directions. As a result, the chattering noise due to the backlash of the helical splines can be suppressed even if the torque to be applied to the intake camshaft 3 backward (for the positive torque) of the rotational direction or forward (for the negative torque) of the rotational direction changes.

[Second Embodiment]

Figure 2:
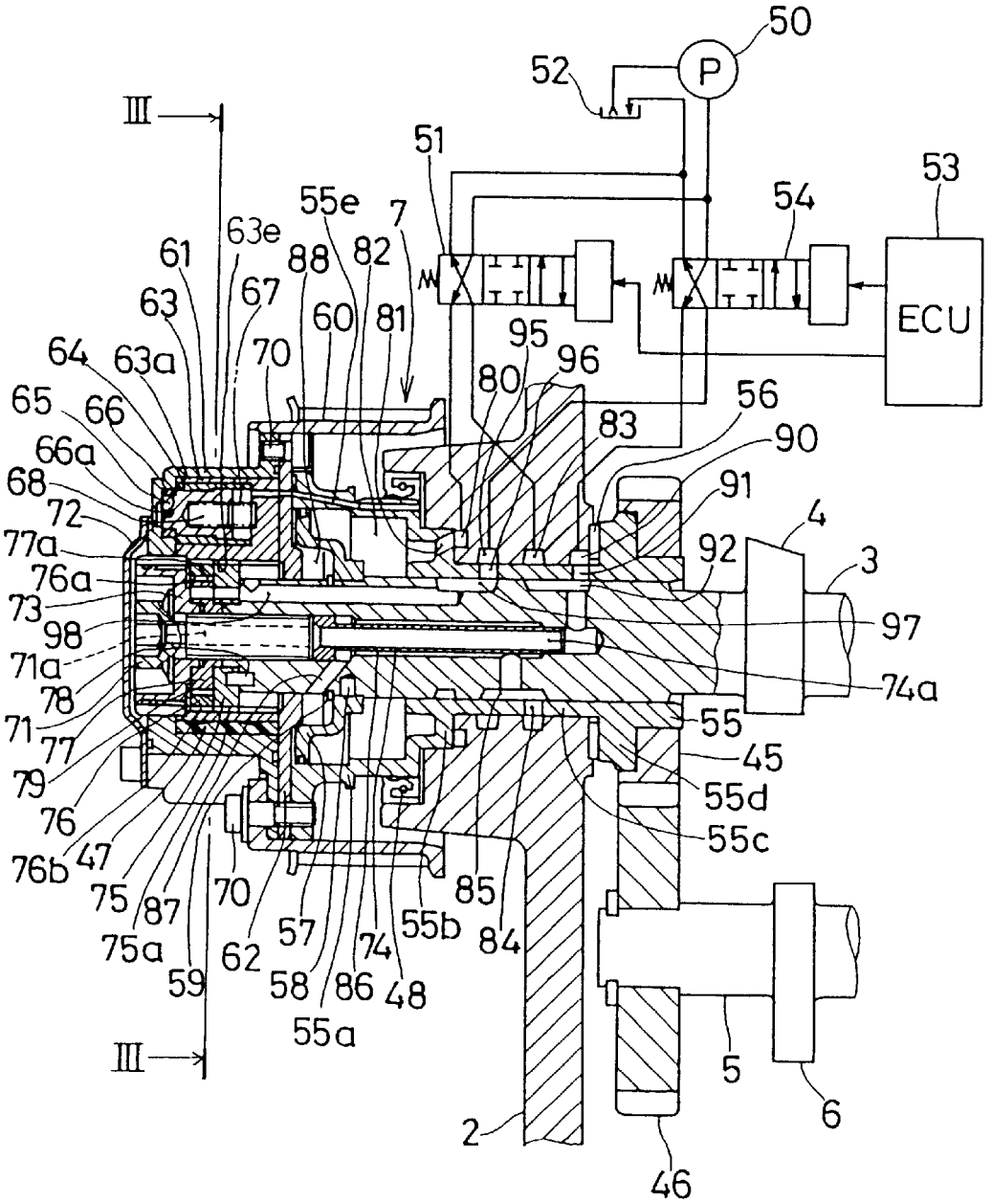
FIG. 2 is a longitudinal sectional view showing a variable valve control apparatus according to a second embodiment of the present invention.
Figure 3:
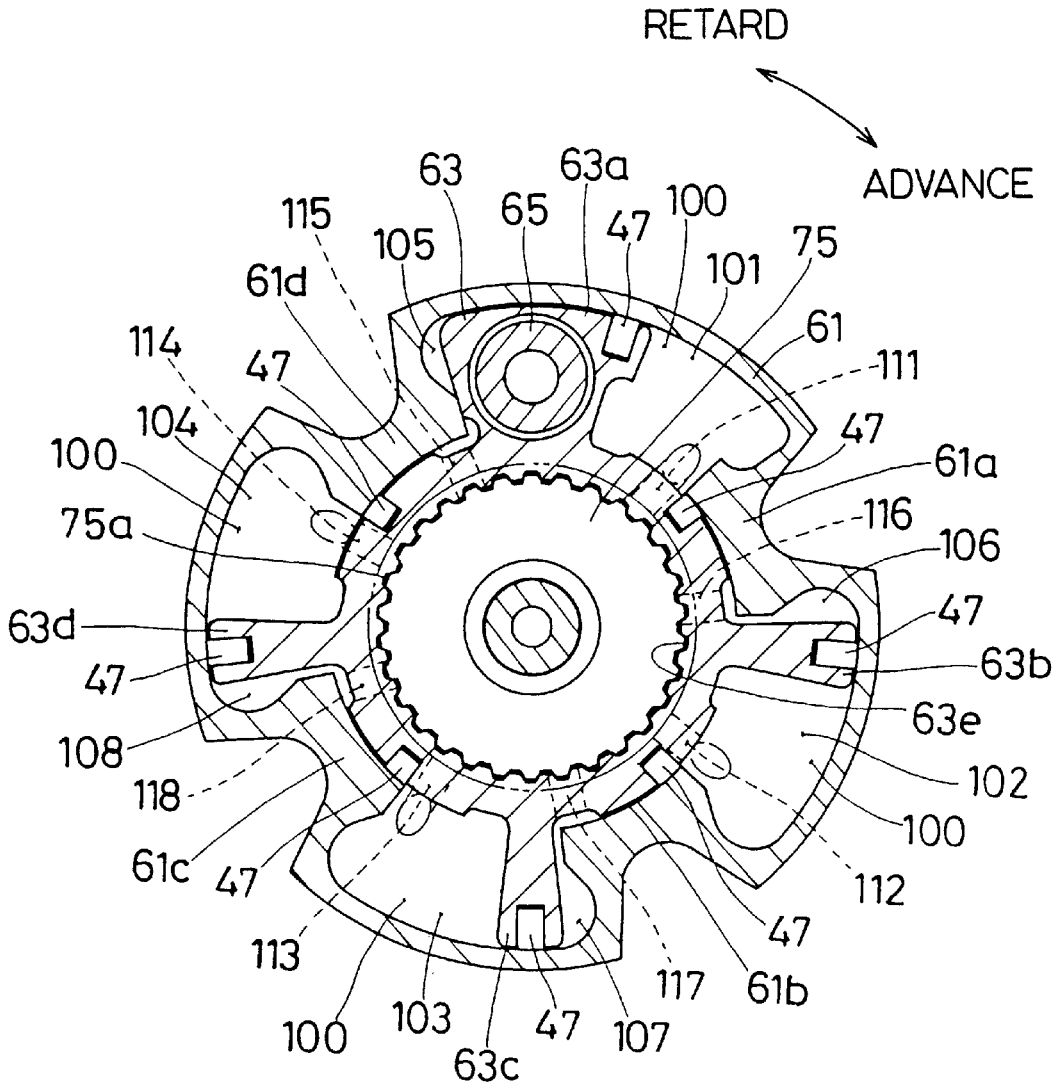
FIG. 3 is a sectional view of a part of the variable valve control apparatus taken along the line III—III of FIG. 2 according to the second embodiment of the present invention.

A second embodiment of the present invention is shown in FIGS. 2 and 3. In this and the other embodiments, components which are substantially the same to those in previous embodiments are assigned the same reference numerals.

A variable valve control apparatus 7 of the second embodiment is a hydraulic control type for transmitting the torque of a crankshaft (not shown) to the intake camshaft 3 and the exhaust camshaft 5.

A timing pulley 60, as shown in FIG. 2, is coupled with the crankshaft via a timing belt (not shown) to receive the torque so that it synchronously rotates with the crankshaft.

A cylindrical portion 55*a*, an annular portion 55*b*, a cylindrical portion 55*c* and an annular portion 55*d* are integrally formed as a rotary member 55. The rotary member 55 is rotatably supported by the cylinder head 2. A thrust bearing 56 is fitted between the cylinder head 2 and the annular portion 55*d*. The rotary member 55 supports the intake camshaft 3 in such a manner that the intake camshaft 3 rotates and axially moves relative to the rotary member 55. Since clearances between the cylinder head 2 and the annular portions 55*b*, 55*d* in the axial direction are only for allowing the rotational slide, the rotary member 55 cannot substantially move in its axial direction.

A bolt 70 combines the timing pulley 60, the cylindrical portion 55*a*, a rear plate 62 and a later-described shoe housing 61. The timing pulley 60, the shoe housing 61, the rear plate 62 and the rotary member 55 comprise a drive side rotor.

The intake camshaft 3 receives the torque from the timing pulley 60 and can rotate with a predetermined phase difference relative to the timing pulley 60. The timing pulley 60 and the intake camshaft 3 rotate clockwise, as viewed from the left-hand side of FIG. 2. This rotational direction will be called "advanced angle direction".

A piston member 57 as the axial moving means is installed radially between the rotary member 55 and the intake camshaft 3, and is assembled with the intake camshaft 3 by a pin 58 and a ring 59 in such a manner that the piston member 57 cannot rotate and axially move relative to the intake camshaft 3 respectively. The piston member 57 divides the oil pressure chamber, defined by the intake camshaft 3, the rotary member 55 and the rear plate 62, into a low speed oil pressure chamber 82 and a high speed oil pressure chamber 88.

The shoe housing 61 constructs together with the rear plate 62 a housing for housing a later-described vane rotor 63. The opening of the shoe housing 61 is closed by a cover 72. The phase adjusting means in the second embodiment comprises the shoe housing 61 and the vane rotor 63.

As shown in FIG. 3, the shoe housing 61 has shoes 61*a*, 61*b*, 61*c* and 61*d* which are formed substantially equidistantly each other in the circumferential direction to have an arc-shaped cross section respectively. In the four circumferential gaps among the shoes 61*a*, 61*b*, 61*c* and 61*d*, there are formed sector spaces 100 which act as housing chambers for housing vanes 63*a*, 63*b*, 63*c* and 63*d* as vane members.

Both axial end surfaces of the vane rotor 63 acting as the driven side rotor are covered by the shoe housing 61 and the rear plate 62. The vane rotor 63 is equipped substantially equidistantly in the circumferential direction with the vanes 63*a*, 63*b*, 63*c* and 63*d*, which are rotatably housed in the sector spaces 100. Arrows in FIG. 3 indicating the retard direction and the advance direction represent the retarded angle direction and the advanced angle direction of the vane rotor 63 relative to the shoe housing 61 respectively. In FIG. 3, each vane is positioned at one circumferential end portion of each sector space 100, and the vane rotor 63 is positioned at the most retarded position relative to the shoe housing 61. This most retarded position is defined by retaining the retard side face of the vane 63*a* on the advance side face of the shoe 61*d*. An internal spline 63*e* is formed on the inner circumferential wall of the vane rotor 63.

A male spline member 75 and a female spline member 76 shown in FIG. 2 are engaged with the vane rotor 63 so that the intake camshaft 3, the male spline member 75 and the female spline member 76 rotate together with the vane rotor 63 and are axially movable back and forth relative to the vane rotor 63.

The male spline member 75 is determined its rotational position by a pin 78 and is mounted on the axial end face of the intake camshaft 3. The male spline member 75 and a diametrically reduced member 77 are fixed to the intake camshaft 3 through a bushing 73 by a bolt 71 in such a manner that the male spline member 75 and the diametrically reduced member 77 are inhibited from rotating relative to the intake camshaft 3.

An external spline 75*a* is formed on the outer circumferential wall of the male spline member 75. The diametrically reduced member 77 has a smaller external diameter than that of the male spline member 75, and has an external helical spline 77*a* formed on its outer circumferential wall.

The female spline member 76 has an internal helical spline 76*a* formed on its inner circumferential wall, and is engaged with the diametrically reduced member 77 via helical spline. On the other hand, the female spline member 76 has an external spline 76*b* formed on the outer circumferential wall, and is engaged with the vane rotor 63 via spline. The female spline member 76 is axially biased by a leaf spring 79 such that its internal helical spline 76*a* may contact against the external helical spline 77*a* of the diametrically reduced member 77 backward of the rotational direction.

By the biasing force of the leaf spring 79, the diametrically reduced member 77 and the male spline member 75 are biased backward of the rotational direction, so that the external spline 75*a* of the male spline member 75 contacts against the internal spline 63*e* of the vane rotor 63 backward of the rotational direction. The female spline member 76 is caused to push the diametrically reduced member 77 backward of the rotational direction by the biasing force of the leaf spring 79 and is biased by itself forward of the rotational direction, so that the external spline 76*b* of the female spline member 76 contacts against the internal spline 63*e* of the vane rotor 63 forward of the rotational direction.

In the second embodiment, the female spline member 76 is engaged with the diametrically reduced member 77 via helical spline, and is axially biased by the leaf spring 79, so that the external spline of the male spline member 75 and the female spline member 76 contact against the internal spline 63*e* of the vane rotor 63 as the driven side rotor respectively while establishing no backlash by deviating the tooth traces backward and forward of the rotational direction. Even if the camshaft 3 receives the positive/negative torque fluctuations, therefore, the chattering noise, as might otherwise be caused by the collisions between the spline teeth, can be prevented at the engaged portions between the male spline member 75 and the female spline member 76 and the vane rotor 63.

As shown in FIG. 3, the seal member 47 is fitted on the outer circumferential wall of the vane rotor 63. Small clearances are formed between the outer circumferential wall of the vane rotor 63 and the inner circumferential wall of the shoe housing 61, and seal members 47 are provided to prevent the working oil from leaking between the oil pressure chambers through those clearances. The seal members 47 are individually pushed onto the inner circumferential wall of the shoe housing 61 by the bias force of the leaf spring.

In the inner wall of the vane 63*a*, as shown in FIG. 2, there is press-fitted and retained a guide ring 64, into which a stopper piston 65 acting as a contact portion is inserted. This stopper piston 65 is formed into a cylindrical shape having a bottom, and is accommodated in the guide ring 64 such that the stopper piston 65 can slide in the axial direction of the intake camshaft 3. The stopper piston 65 is biased toward a later-described stopper bore 66*a* by a spring 67.

A fitted ring 66 is fitted in a fitting hole formed in the shoe housing 61, while having the stopper bore 66*a* in its inner circumferential wall. The stopper piston 65 can be fitted in the stopper bore 66*a* at the position of the most retarded angle. With the stopper piston 65 being fitted in the stopper bore 66*a* and contacting against it in the rotational direction, the rotation of the vane rotor 63 relative to the shoe housing 61 is restrained. In other words, the stopper piston 65 and the stopper bore 66*a* are holding each other at the position of the most retarded angle.

The stopper piston 65 receives the oil pressure from both the advance side and the retard side. The force, at the pressure receiving surface of the stopper piston 65, receiving from the working oil acts in the direction to disengage the stopper piston 65 from the stopper bore 66*a*. When an oil pressure equal to or higher than a predetermined level is applied to the stopper piston 65, this stopper piston 65 is disengaged from the stopper bore 66*a* against the bias force of the spring 67.

The stopper piston 65 and the stopper bore 66*a* are so positioned that the stopper piston 65 can be fitted in the stopper bore 66*a* by the bias force of the spring 67 when the vane rotor 63 is at the most retarded position relative to the shoe housing 61, that is, when the intake camshaft 3 is at the most retarded position relative to the crankshaft.

In the rear plate side of the vane 63*a* and in the rear plate 62, as shown in FIG. 2, here is formed a communication passage for providing the communication between a back pressure chamber 68 of the stopper piston 65 and an air vent passage 55 formed in the cylindrical portion 55*a*. The back pressure chamber 68 and the air vent passage 55*e* communicate with each other at the most retarded position. The air vent passage 55*e* is vented to the oil lubrication space of the engine via periphery of the oil seal 48. As a result, the back pressure chamber 68 is vented to the atmosphere at the most retard position, and the movement of the stopper piston 65 is not obstructed. When the vane rotor 63 rotates from the most retarded position toward the advance side, that is, when the vane rotor 63 rotates to disengaged position at which the stopper piston 65 disengages from the stopper bore 66*a*, the communication between the back pressure chamber 68 and the air vent passage 55*e* is terminated.

As shown in FIG. 3: a retard oil pressure chamber 101 is formed between the shoe 61*a* and the vane 63*a*; a retard oil pressure chamber 102 is formed between the shoe 61*b* and the vane 63*b*; a retard oil pressure chamber 103 is formed between the shoe 61*c* and the vane 63*c*; and a retard oil pressure chamber 104 is formed between the shoe 61*d* and the vane 63*d*. On the other hand: an advance oil pressure chamber 105 is formed between the shoe 61*d* and the vane 63*a*; an advance oil pressure chamber 106 is formed between the shoe 61*a* and the vane 63*b*; an advance oil pressure chamber 107 is formed between the shoe 61*b* and the vane 63*c*; and an advance oil pressure chamber 108 is formed between the shoe 61*c* and the vane 63*d*. Each of the oil pressure chambers constructs a drive liquid pressure chamber.

As shown in FIG. 2, annular oil passages 80, 83, 90 and 95 are formed in the inner circumferential wall of the cylinder head 2. The oil passages 83 and 95 are formed between the oil passage 80 and the oil passage 90. These oil passages 80 and 83 can be connected to either of the hydraulic pump 50 acting as the drive source or the drain 52 via the switching valve 51. On the other hand, the oil passages 90 and 95 can be connected to either of the hydraulic pump 50 acting as the drive source or the drain 52 via a switching valve 54. The switching valves 51 and 54 can independently switch the oil passages in response to a command from the ECU 53.

A communication port 81 is formed in the annular portion 55*b* of the rotary member 55, and communication ports 84, 91 and 96 are formed in the cylindrical portion 55*c*. In the outer circumferential wall of the intake camshaft 3, there are formed oil pressure chambers 85, 92 and 97 which have arc-shaped transverse cross sections.

The oil passage 80 communicates with the low speed oil pressure chamber 82 via the communication port 81. The oil passage 83 communicates with the high speed oil pressure chamber 88 via the communication port 84, the oil pressure chamber 85, an oil passage 86 formed between an oil passage member 74 and the intake camshaft 3, and an oil passage 87 formed in the intake camshaft 3.

When the intake valve is driven by the cam 4, the intake camshaft 3 receives the thrust force leftward in FIG. 2 because of the tapered profile. When the piston member 57 is controlled to move axially, therefore, the high speed oil pressure chamber 88 requires a higher oil pressure than that of the low speed oil pressure chamber 82 does. In other words, the oil pressure to be applied to the oil passage 83 is higher than that to the oil passage 80.

By controlling the switching valve 51 to change the connections between the oil passages 80, 83 and the hydraulic pump 50 and the drain 52, the oil pressures in the low speed oil pressure chamber 82 and the high speed oil pressure chamber 88 are adjusted. By axially moving or stopping the piston member 57, moreover, the intake camshaft 3 is axially moved or stopped, so that the profile of the cam 4 for driving the intake valve is changed to control the opening/closing timing, the open period and the lifting stroke of the intake valve.

The oil passage 90 communicates with the retard oil pressure chambers 101, 102, 103 and 104 from the communication port 91, the oil pressure chamber 92, an oil passage 74*a* formed in the inner circumference of the oil passage member 74 and an oil passage 71*a* formed in the bolt 71, via oil passages 111, 112, 113 and 114. The oil passage 95 communicates with the advance oil pressure chambers 105, 106, 107 and 108 from the communication port 96, the oil pressure chamber 97 and an oil passage 98 via oil passages 115, 116, 117 and 118.

When the cam 4 drives the intake valve, the cam 4 receives the positive/negative fluctuating torque. These fluctuating torque have an average value on the positive torque side. In other words, the intake camshaft 3 and the vane rotor 63 receive the fluctuating torque to the retard side on average. When the vane rotor 63 is controlled in phase relative to the shoe housing 61, therefore, the advance oil pressure chamber requires a higher oil pressure than that of the retard oil pressure chamber does. In short, the oil pressure to be applied to the oil passage 95 is higher than that to the oil passage 90.

By controlling the switching valve 54 to change the connections between the oil passages 90 and 91 and the hydraulic pump 50 and the drain 52, the oil pressures in the retard oil pressure chambers 101, 102, 103 and 104 and the advance oil pressure chambers 105, 106, 107 and 108 are adjusted. Accordingly, the rotational phase of the vane rotor 63 relative to the timing pulley 60 is adjusted.

Operations of the variable valve control apparatus 7 will now be described.

When the engine is started, that is, before the working oil is introduced from the hydraulic pump into the respective oil pressure chambers, the vane rotor 63 is at the most retarded position, as shown in FIGS. 2 and 3, relative to the shoe housing 61 as the crankshaft rotates. The top end portion of the stopper piston 65 is fitted in the stopper bore 66*a* by the bias force of the spring 67, so that the vane rotor 63 and the shoe housing 61 are firmly held together. As a result, even if the intake camshaft 3 is subject to the positive/negative torque fluctuations when the intake valve is driven, the movement of the vane rotor 63 toward the retard side and the advance side relative to the shoe housing 61 is restrained, thereby preventing the relative rotational vibration. Accordingly, the shoe housing 61 and the vane rotor 63 are prevented from colliding and generating chattering noise.

When the intake camshaft 3 receives positive torque fluctuation, the external spline of the positive spline member 75 receives the positive torque backward in the rotational direction because it is contacting against the internal spline 63*e* of the vane rotor 63. When the intake camshaft 3 receives negative torque fluctuation, the external spline of the female spline member 76 receives the negative torque forward in the rotational direction because it is contacting against the internal spline 63*e*. Accordingly, the collisions of the spline and the generation of the chattering noise are reduced even if the intake camshaft 3 receives the positive/negative torque fluctuations.

When the working oil is not introduced to the low speed oil pressure chamber 82 and the high speed oil pressure chamber 88, the cam 4 receives the thrust force leftward in FIG. 2 when the intake valve is driven. Accordingly, the intake camshaft 3 moves leftward in FIG. 2. It is, therefore, the low speed profile of the cam 4 that drives the intake valve at the start of the engine.

After the start of the engine, the working oil is supplied from the hydraulic pump 50 to the respective retard oil pressure chambers. Since the retard oil pressure is also applied to the stopper piston 65 via the retard oil pressure chamber 101, the stopper piston 65 is disengaged from the stopper bore 66*a* against the bias force of the spring 67 when the oil pressure in the retard oil pressure chamber 101 exceeds a predetermined level. This allows the vane rotor 63 to rotate freely relative to the shoe housing 61. Since the vane rotor 63 is held at the most retarded position as shown in FIG. 3, by receiving the oil pressure on the retard side from the respective retard oil pressure chambers, however, the shoe housing 61 and the vane rotor 63 are prevented from colliding and generating chattering noise even if the intake camshaft 3 receives the positive/negative torque fluctuations at the time of driving the intake valve.

Next, in order to rotate the vane rotor 63 from the most retarded position shown in FIG. 3 toward the advance side, the switching valve 54 is switched to open the respective retard oil pressure chambers to the atmosphere thereby supplying the working oil to the respective advance oil pressure chambers. At this time, the advance oil pressure is applied to the stopper piston 65 from the advance oil pressure chamber 105, so that the stopper piston 65 is kept its disengaged state from the stopper bore 66*a*. When the oil pressure in the respective advance oil pressure chambers exceeds the predetermined level, the vane rotor 63 rotates from the most retarded position toward the advance side while the stopper piston 65 being out of the stopper bore 66*a*, so that the stopper piston 65 and the stopper bore 66*a* are deviated from each other in the circumferential direction, and the stopper piston 65 is located at a position that it is not engaged with the stopper bore 66*a*.

Thereafter, in response to the command from the ECU according to the engine running condition, the switching valve 54 is switched to control the oil pressures in the respective retard oil pressure chambers and the respective advance oil pressure chambers, thereby controlling the rotational phase of the vane rotor 63 relative to the shoe housing 61, that is, the rotational phase difference between the intake camshaft 3 and the crankshaft. This makes it possible to control the timing for opening/closing the intake valve accurately.

By switching the switching valve 51 according to the engine running condition to move the intake camshaft 3 axially, moreover, the opening/closing timing, the opening period and the lifting stroke of the intake valve are controlled.

According to the second embodiment of the present invention, the phase control by the shoe housing 61 and the vane rotor 63, and the axial movement control of the intake camshaft 3 by the piston member 57, can be performed independently of each other by controlling the switching valve 51 and the switching valve 54.

Furthermore, the high pressure oil passages 83 and 95 are formed between the low pressure oil passages 80 and 90. More specifically, the working oil can leak out from the low pressure oil passages 80 and 90 to the atmosphere, so that the oil pressure in the oil passages 80 and 90 will not rise more than necessary even if the working oil leaks from the oil passages 83 and 95 to the oil passages 80 and 90. Since the oil pressure control is performed with the oil pressure difference, the fact that the oil pressure in the oil passages 80 and 90 does not rise more than necessary makes easier to control the pressure difference. This makes it possible to control the rotational phase of the intake camshaft 3 relative to the timing pulley 60 with high degree of accuracy. As compared with the case in which the low pressure oil passages 80 and 90 are arranged axially between the high pressure oil passages 83 and 95, moreover, the pressure difference between the low pressure oil passages 80 and 90 and the atmospheric pressure are lower than the pressure difference between the high pressure oil passages 83 and 95 and the atmospheric pressure. Therefore, the oil amount leaks out to the atmosphere is reduced. Accordingly, the response of the phase control and the axial movement control is improved.

In addition, the male spline member 75 and the female spline member 76 are so circumferentially positioned and mounted on the intake camshaft 3 not to rotate relative to the intake camshaft 3 that their external spline may contact against the internal spline 63*e* of the vane rotor 63 forward and backward of the rotational direction and the same direction with the deviated tooth traces to establish no backlash. Even if the intake camshaft 3 receives the positive/negative torque fluctuations, therefore, the chattering noise, as might otherwise be generated by the collisions between the spline, can be prevented at the spline portion between the vane rotor 63 and the male and female spline members 75 and 76.

In the second embodiment, the piston member 57 for axially moving the intake camshaft 3 is accommodated in the rotary member 55 functioning as the drive side rotor. In other words, the phase adjusting means and the axial moving means of the intake camshaft 3 are constructed as one assembled driving means at one end portion of the intake camshaft 3. However, it is possible to install the axial moving means at the other end portion of the intake camshaft 3 separately from the phase adjusting means.

In the second embodiment, the male and negative spline members 75 and 76 and the vane rotor 63 are engaged by the straight spline. Alternatively, it is possible to engage by the helical spline.

Furthermore, there is adopted the construction in which the torque of the crankshaft is transmitted by the timing pulley 60 to the intake camshaft 3 and the exhaust camshaft 5. The construction can be modified by using a chain sprocket or a timing gear. Another modification may be such that the torque of the crankshaft acting as the drive shaft is received by the vane rotor to rotate the intake camshaft and the shoe housing integrally.

[Third Embodiment]

Figure 4:
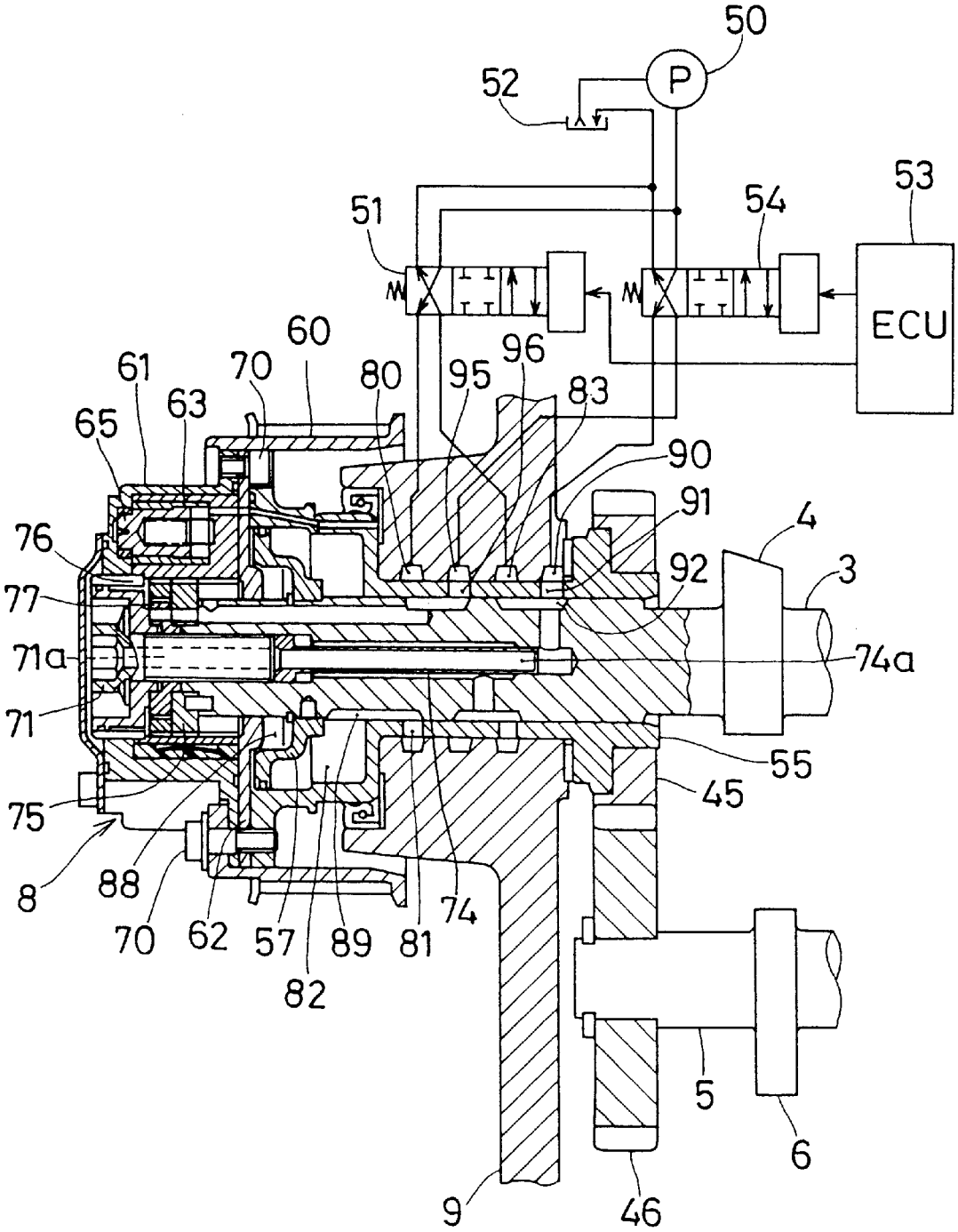
FIG. 4 is a longitudinal sectional view showing a variable valve control apparatus according to a third embodiment of the present invention.

A third embodiment of the present invention is shown in FIG. 4.

In the variable valve control apparatus 8 of the third embodiment, the oil passages 80, 83, 90 and 95 to be formed in the inner circumferential wall of a cylinder head 9 are all arranged in the axial direction as shown in FIG. 4. This shortens the working time period because it is sufficient to move the tool for forming the oil passages 80, 83, 90 and 95 only in the axial direction.

According to the embodiments of the present invention described above, the phase adjusting means and the axial moving means of the intake camshaft 3 are constructed by the single drive means which is assembled at the end portion of the intake camshaft 3. As a result, the number of parts is decreased to reduce the number of their assembling steps, so that the size of the entire apparatus is reduced to lower the manufacture cost.

According to the embodiments of the present invention, furthermore, the rotary member rotatably supports the intake camshaft 3 and allows the axial movement of the intake camshaft 3, and the rotary member is supported axially immovably by the cylinder head. Moreover, the rotary member to rotate together with the timing pulley drives the exhaust camshaft 5. As a result; (1) the gear engagement between the rotary member and the exhaust camshaft 5 is not disengaged even if the intake camshaft 3 axially moves, so that the gear is reduced in size without enlarging the axial length of the gear; (2) The rotational phase of the exhaust camshaft 5 relative to the timing pulley does not change even if the intake camshaft 3 axially moves, so that the gear engagement between the rotary member and the exhaust camshaft 5 is achieved by helical gears; As a result, a high torque can be transmitted with the same axial gear length from the rotary member to the exhaust camshaft 5; (3) The rotational phase of the exhaust camshaft 5 relative to the timing pulley does not change even if the rotational phase of the intake camshaft 3 relative to the timing pulley changes. As a result, the relative phase difference between the camshafts is controlled with high degree of accuracy.

In the embodiments of the present invention described above, the rotational phase of the intake camshaft 3 is adjusted relative to the timing pulley whereas the exhaust camshaft 5 has the same phase as the timing pulley has. However, the construction may be modified such that the rotational phase of the exhaust camshaft 5 is adjusted relative to the timing pulley whereas the intake camshaft 3 has the same phase as the timing pulley has. In this modification, the intake camshaft 3 and the exhaust camshaft 5 are exchanged, so that the torque of the crankshaft is transmitted from the exhaust camshaft 5 to the intake camshaft 3.

For the torque transmission from the rotary member to the exhaust camshaft 5, not only the gear but also a chain or belt may be used instead.

Furthermore, the embodiments of the present invention have been described on the variable valve control system in which the intake valve is driven by the intake camshaft 3 whereas the exhaust valve is driven by the exhaust camshaft 5. However, the invention can also be embodied by a variable valve control apparatus in which both the intake valve and the exhaust valve are driven by one camshaft.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A variable valve control apparatus for an internal combustion engine having an intake valve, an exhaust valve and a drive shaft, comprising:

an axially-movable first driven shaft having a multi-dimensional cam for opening and closing at least one of the intake valve and the exhaust valve;

a drive side rotor for rotating together with the drive shaft;

a rotary member forming a part of said drive side rotor for rotatably supporting said first driven shaft and for allowing axial movement of said first driven shaft;

a support member for rotatably supporting said rotary member and for inhibiting axial movement of said rotary member;

a driven side rotor rotatably assembled to said drive side rotor and controlled hydraulically in a rotational phase relative to said drive side rotor for rotating together with said first driven shaft; and a hydraulically controlled piston housed inside said drive side rotor and for moving axially together with said first driven shaft.

2. A variable valve control apparatus according to claim 1, wherein:

said first driven shaft opens and closes one of the intake valve and the exhaust valve;

the apparatus further includes an axially immovable second driven shaft for opening and closing the other of the intake valve and the exhaust valve; and said rotary member drives said second driven shaft.

3. A variable valve control apparatus according to claim 1, further comprising:

a pair of first fluid passages provided along an axial direction of said rotary member and provided at a rotational sliding portion between said support member and said rotary member for said hydraulic controls; and a second fluid passage provided between said pair of first fluid passages in said axial direction of said rotary member and provided at said rotational sliding portion for said hydraulic controls; wherein fluid pressure of said first fluid passages is less than that of said second fluid passage.

4. A variable valve control apparatus according to claim 1, wherein said driven side rotor and said piston are located at one end of said first driven shaft.

5. A variable valve control apparatus for an internal combustion engine having an intake valve, an exhaust valve and a drive shaft, comprising:

an axially-movable first driven shaft having a multi-dimensional cam for opening and closing one of the intake valve and the exhaust valve;

a drive side rotor for rotating together with the drive shaft;

a rotary member forming a part of said drive side rotor for rotatably supporting said first driven shaft and for allowing axial movement of said first driven shaft;

a support member for rotatably supporting said rotary member and for inhibiting axial movement of said rotary member;

a driven side rotor rotatably assembled to said drive side rotor and controlled hydraulically in a rotational phase relative to said drive side rotor for rotating together with said first driven shaft; and a second driven shaft which is axially immovable for opening and closing the other of the intake valve and the exhaust valve, wherein;

said rotary member drives said second driven shaft.

6. A variable valve control apparatus for an internal combustion engine having an intake valve, an exhaust valve and a crank shaft, comprising:

an axially-movable first driven shaft having a multi-dimensional cam for opening and closing at least one of the intake valve and the exhaust valve;

a drive side rotor to be rotated by the crankshaft;

a rotary member forming a part of said drive side rotor for rotatably supporting said first driven shaft and for allowing axial movement of said first driven shaft;

a support member for rotatably supporting said rotary member and for inhibiting axial movement of said rotary member;

a driven side rotor rotatably assembled to said drive side rotor and controlled hydraulically in a rotational phase relative to said drive side rotor for rotating together with said first driven shaft;

hydraulically controlled rotational phase adjusting means for adjusting said rotational phase between said drive side rotor and said driven side rotor; and hydraulically controlled axial moving means for axially moving said first driven shaft;

wherein said rotational phase adjusting means and said axial moving means are located at one end of said first driven shaft.

* * * * *